US009165507B2

(12) United States Patent
Li et al.

(10) Patent No.: US 9,165,507 B2
(45) Date of Patent: Oct. 20, 2015

(54) LIGHTING SYSTEM HAVING INTERLACED DRIVING MECHANISM

(71) Applicant: AU Optronics Corp., Hsin-Chu (TW)

(72) Inventors: Yueh-Han Li, Hsin-Chu (TW); Huang-Ti Lin, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 346 days.

(21) Appl. No.: 13/657,879

(22) Filed: Oct. 23, 2012

(65) Prior Publication Data

US 2013/0113384 A1 May 9, 2013

(30) Foreign Application Priority Data

Nov. 4, 2011 (TW) ..... 100140416 A

(51) Int. Cl.
*H05B 39/00* (2006.01)
*G09G 3/34* (2006.01)

(52) U.S. Cl.
CPC ..... *G09G 3/34* (2013.01)

(58) Field of Classification Search
CPC ..... G09G 2320/0233; G09G 2330/021; H01L 27/3244
USPC ..... 315/161–179
See application file for complete search history.

(56) References Cited

U.S. PATENT DOCUMENTS

2010/0073271 A1 3/2010 Hwang et al.

FOREIGN PATENT DOCUMENTS

| | | | |
|---|---|---|---|
| CN | 101586751 A | * | 11/2009 |
| CN | 101923841 A | | 12/2010 |
| EP | 2607948 | | 6/2013 |
| TW | M414047 | | 10/2011 |

* cited by examiner

*Primary Examiner* — Douglas W Owens
*Assistant Examiner* — Monica C King
(74) *Attorney, Agent, or Firm* — Winston Hsu; Scott Margo

(57) ABSTRACT

A lighting system includes a first lighting unit for generating output light according to a first current, a second lighting unit for generating output light according to a second current, a third lighting unit for generating output light according to a third current, a fourth lighting unit for generating output light according to a fourth current, a first power driving unit electrically connected to the first and third lighting units, and a second power driving unit electrically connected to the second and fourth lighting units. The second lighting unit is disposed between the first and third lighting units. The third lighting unit is disposed between the second and fourth lighting units. The first power driving unit is employed to drive the first and third currents. The second power driving unit is employed to drive the second and fourth currents.

14 Claims, 11 Drawing Sheets

LIGHTING SYSTEM HAVING INTERLACED DRIVING MECHANISM

BACKGROUND

1. Technical Field

The present disclosure relates to a lighting system, especially to a lighting system having interlaced driving mechanism.

2. Description of the Prior Art

Flat panel displays (FPDs) are widely used displays nowadays. Because FPDs have slim shapes, low power dissipation and low radiation, FPDs are widely applied on mobile electronic devices as monitors, cell phones, notebooks, televisions and PDAs (personal digital assistants). When operating an FPD, the transmittances of the pixels are adjusted by utilizing a backlight module, so that the FPD can display images accordingly. Thus, the backlight module is a key element for operating an FPD. Please refer to FIG. 1, FIG. 1 shows a related art lighting system 100 operated as a backlight module. As depicted in FIG. 1, the lighting system 100 includes a plurality of power driving units 111-112, a plurality of lighting units 121-124, a circuit board 170 and a plurality of current control units 191-194. For reducing the length of wires and simplifying the circuit layout of the lighting system 100, the lighting units 121-124 are configured sequentially on the circuit board 170. That is, the lighting unit 122 is configured between the lighting units 121 and 123, and the lighting unit 123 is configured between the lighting units 122 and 124. The first power driving unit 111 is electrically connected to the neighboring lighting units 121 and 122, and the second power driving unit 112 is electrically connected to the neighboring lighting units 123 and 124. The first power driving unit 111 is used to provide the first sub-current Id1 to the first lighting unit 121 and provide the second sub-current Id2 to the second lighting unit 122. The first current Ip1 is the combined current of the first sub-current Id1 and the second sub-current Id2. The second power driving unit 112 is used to provide the third sub-current Id3 to the third lighting unit 123 and provide the fourth sub-current Id4 to the fourth lighting unit 124. The second current Ip2 is the combined current of the third sub-current Id3 and the fourth sub-current Id4. The first to fourth current control units 191-194 are electrically connected to the first to fourth lighting units 121-124 to control the first to fourth sub-currents Id1-Id4 respectively.

Please refer to FIG. 2, FIG. 2 shows the waveforms of signals for operating the lighting system 100 of FIG. 1. The horizontal axis represents time. In FIG. 2, waveforms of the first sub-current Id1, the second sub-current Id2, the third sub-current Id3, the fourth sub-current Id4, the first current Ip1 and the second current Ip2 are shown from top to bottom. As depicted in FIG. 2, the phase difference of two successive currents of the first sub-current Id1 to the fourth sub-current Id4 is 90 degrees. During period T11, because the levels of the first sub-current Id1 and the second sub-current Id2 are both at a turn-on level Ion, the level of the first current Ip1 equals to 2Ion. Thus, the output power of the first power driving unit 111 equals to the first power voltage Vp1 multiplied by 2Ion. Similarly, during period T12, because the levels of the third sub-current Id3 and the fourth sub-current Id4 are both at the turn-on level Ion, the level of the second current Ip2 equals to 2Ion. Thus, the output power of the second power driving unit 112 equals to the second power voltage Vp2 multiplied by 2Ion. Therefore, the rated power of the first power driving unit 111 must exceed 2Ion×Vp1, and the rated power of the second power driving unit 112 must exceed 2Ion×Vp2. Besides, when operating a stereoscopic display device to perform three-dimensional (3D) images for each eye of a user to receive different images, in order to avoid reducing the brightness of images, the brightness of the light outputted from a backlight module is usually doubled. Please refer to FIG. 3, FIG. 3 shows the waveforms of signals for operating the lighting system of FIG. 1 to drive a stereoscopic display device. The horizontal axis represents time. As depicted in FIG. 3, when the variation range of levels of the first sub-current Id1 and the second sub-current Id2 are both doubled to 2Ion, the variation range of the level of the first current will reach 4Ion, thus the output power of the first power driving unit 111 must exceed 4Ion×Vp1. Similarly, the output power of the second power driving unit 112 must exceed 4Ion×Vp2. Therefore, the manufacturing cost is raised and the design complexity is heightened.

Please refer to FIG. 4, FIG. 4 shows another related art lighting system 200 operated as a backlight module. As shown in FIG. 4, the lighting system 200 includes a plurality of power driving units 211-212, a plurality of lighting units 221-226, a circuit board 270 and a plurality of current control units 291-296. The lighting units 221-226 are configured on the circuit board 270 sequentially. For reducing the length of traces and simplifying the circuit layout of the lighting system 200, the first power driving unit 211 is electrically connected to the first to third lighting units 221-223. The second power driving unit 212 is electrically connected to the fourth to sixth lighting units 224-226. The first power driving unit 211 is used to provide the first sub-current Id1 to the first lighting unit 221, the second sub-current Id2 to the second lighting unit 222 and the third sub-current Id3 to the third lighting unit 223. The first current Ip1 is the combined current of the first sub-current Id1, the second sub-current Id2 and the third sub-current Id3. The second power driving unit 212 is used to provide the fourth sub-current Id4 to the fourth lighting unit 224, the fifth sub-current Id5 to the fifth lighting unit 225 and the sixth sub-current Id6 to the sixth lighting unit 226. The second current Ip2 is the combined current of the fourth sub-current Id4, the fifth sub-current Id5 and the sixth sub-current Id6. The first to sixth current control units 291-296 are electrically connected to the first to sixth lighting units 221-226 to control the first to sixth sub-currents Id1-Id6 respectively.

Please refer to FIG. 5, FIG. 5 shows the waveforms of signals for operating the lighting system 200 of FIG. 1. The horizontal axis represents time. In FIG. 5, waveforms of the first sub-current Id1, the second sub-current Id2, the third sub-current Id3, the fourth sub-current Id4, the fifth sub-current Id5, the sixth sub-current Id6, the first current Ip1 and the second current Ip2 are shown from top to bottom. As depicted in FIG. 5, the phase difference between two successive currents of the first sub-current Id1 to the sixth sub-current Id6 is 60 degree. During period T21, because the levels of the first sub-current Id1, the second sub-current Id2 and the third sub-current Id3 are all at a turn-on level Ion, the level of the first current Ip1 equals to 3Ion. Thus, the output power of the first power driving unit 211 equals to the first power voltage Vp1 multiplied by 3Ion. Similarly, during period T22, because the levels of the fourth sub-current Id4, the fifth sub-current Id5 and the sixth sub-current Id6 are all at the turn-on level Ion, the level of the second current Ip2 equals to 3Ion. Thus, the output power of the second power driving unit 212 equals to the second power voltage Vp2 multiplied by 3Ion. Therefore, the rated power of the first power driving unit 211 must exceed 3Ion×Vp1, and the rated power of the second power driving unit 212 must exceed 3Ion×Vp2. Besides, when operating a stereoscopic display device to perform three-dimensional (3D) images for each eye of a user to receive different images, in order to avoid reducing the brightness of images, the brightness of the light outputted from a backlight module is usually doubled. When the variation range of levels of the first sub-current Id1, the second sub-current Id2 and the third sub-current Id3 are all doubled to 2Ion, the variation range of the level of the first current will reach 6Ion, thus the output power of the first power driving unit 211 must exceed 6Ion×Vp1. Similarly, the output power of the second power driving unit 112 must exceed 6Ion×Vp2. Therefore, the manufacturing cost is raised and the design complexity is heightened.

SUMMARY

An embodiment of the present disclosure relates to a lighting system having interlaced driving mechanism. The lighting system includes a first lighting unit for generating output light with first brightness according to a first current, a second lighting unit disposed adjacent to the first lighting unit for generating output light with second brightness according to a second current, a third lighting unit disposed not adjacent to the first lighting unit for generating output light with third brightness according to a third current, a fourth lighting unit disposed adjacent to the third lighting unit but not adjacent to the first lighting unit and the second lighting unit for generating output light with fourth brightness according to a fourth current, a first power driving unit electrically connected to the first lighting unit and the third lighting unit for providing the first current to the first lighting unit and the third current to the third lighting unit, and a second power driving unit electrically connected to the second lighting unit and the fourth lighting unit for providing the second current to the second lighting unit and the fourth current to the fourth lighting unit.

Another embodiment of the present disclosure relates to a lighting system having interlaced driving mechanism. The lighting system includes first to sixth lighting units and first to third power driving units. The first lighting unit is used for generating output light with first brightness according to a first current. The second lighting unit is disposed adjacent to the first lighting unit for generating output light with second brightness according to a second current. The third lighting unit is disposed adjacent to the second lighting unit but not adjacent to the first lighting unit for generating output light with third brightness according to a third current. The fourth lighting unit is disposed adjacent to the third lighting unit but not adjacent to the first lighting unit and the second lighting unit for generating output light with fourth brightness according to a fourth current. The fifth lighting unit is disposed adjacent to the fourth lighting unit but not adjacent to the first lighting unit, the second lighting unit and the third lighting unit for generating output light with fifth brightness according to a fifth current. The sixth lighting unit is disposed adjacent to the fifth lighting unit but not adjacent to the first lighting unit, the second lighting unit, the third lighting unit and the fourth lighting unit for generating output light with sixth brightness according to a sixth current. The first power driving unit is electrically connected to the first lighting unit and the fourth lighting unit for providing the first current to the first lighting unit and the fourth current to the fourth lighting unit. The second power driving unit is electrically connected to the second lighting unit and the fifth lighting unit for providing the second current to the second lighting unit and the fifth current to the fifth lighting unit. The third power driving unit is electrically connected to the third lighting unit and the sixth lighting unit for providing the third current to the third lighting unit and the sixth current to the sixth lighting unit.

These and other objectives of the present disclosure will no doubt become obvious to those of ordinary skill in the art after reading the following detailed description of the preferred embodiment that is illustrated in the various figures and drawings.

DETAILED DESCRIPTION

Figure 1:
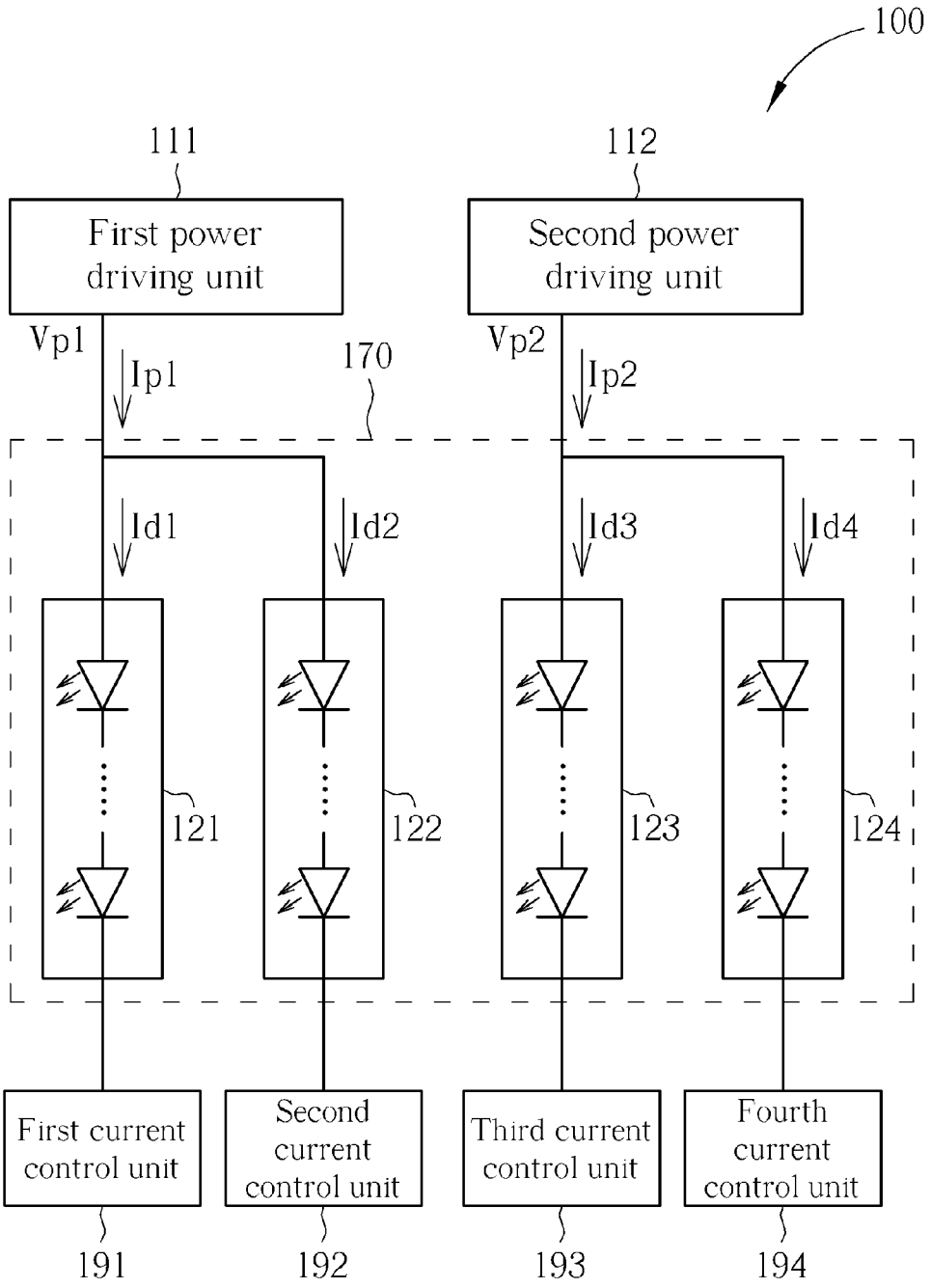
FIG. 1 PRIOR ART
FIG. 1 shows a related art lighting system operated as a backlight module.
Figure 2:
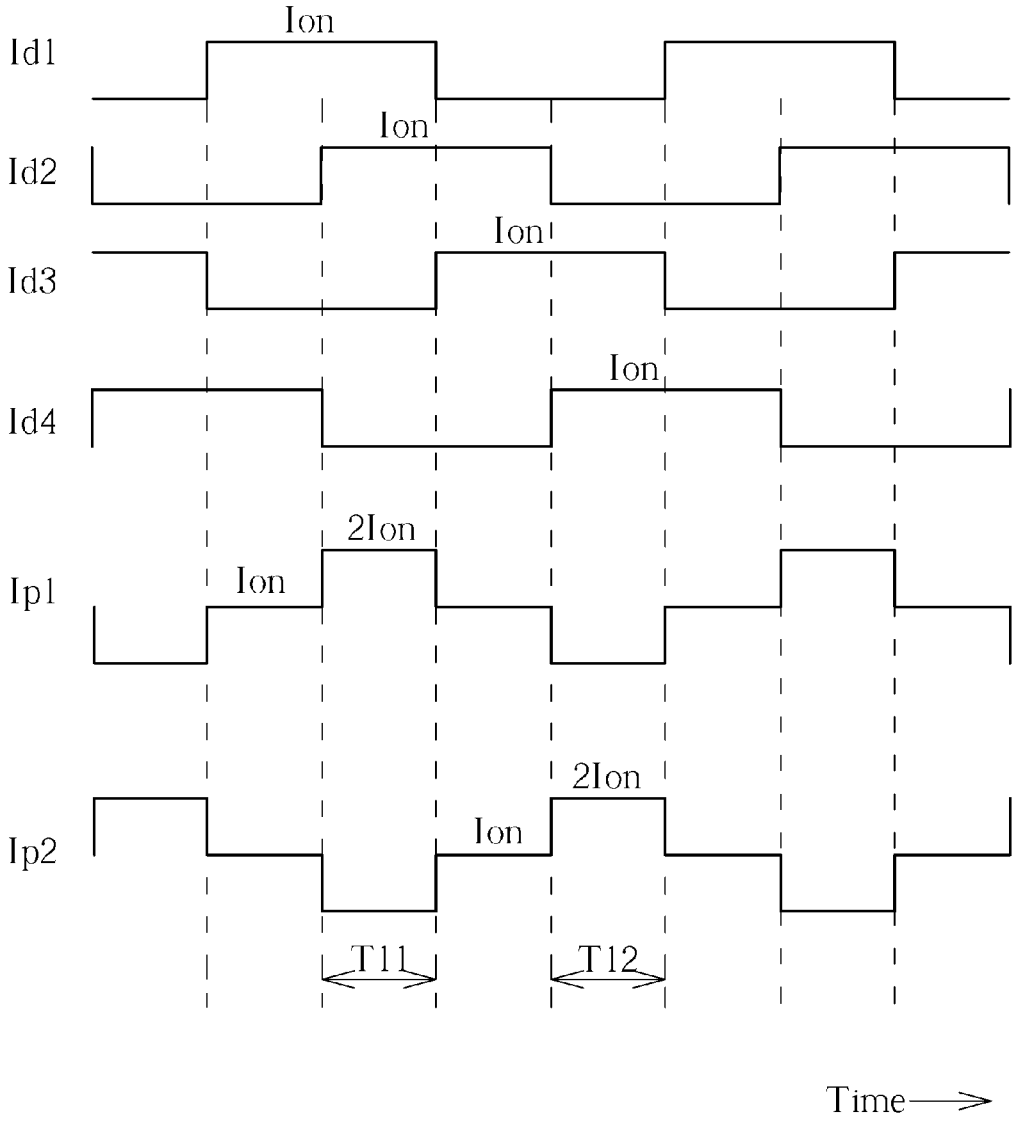
FIG. 2 PRIOR ART
FIG. 2 shows the waveforms of signals for operating the lighting system of FIG. 1.
Figure 3:
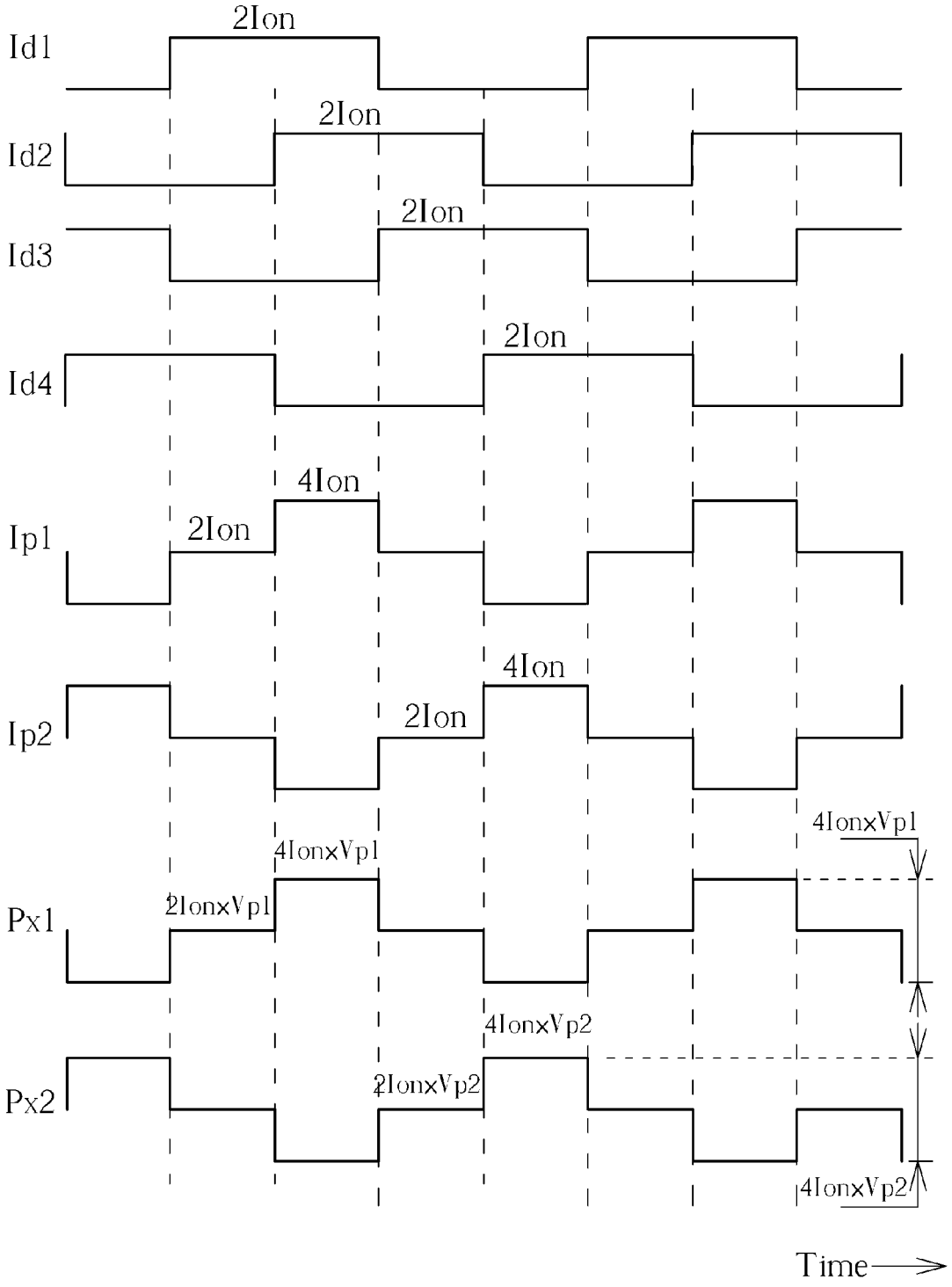
FIG. 3 PRIOR ART
FIG. 3 shows the waveforms of signals for operating the lighting system of FIG. 1 to drive a stereoscopic display device.
Figure 4:
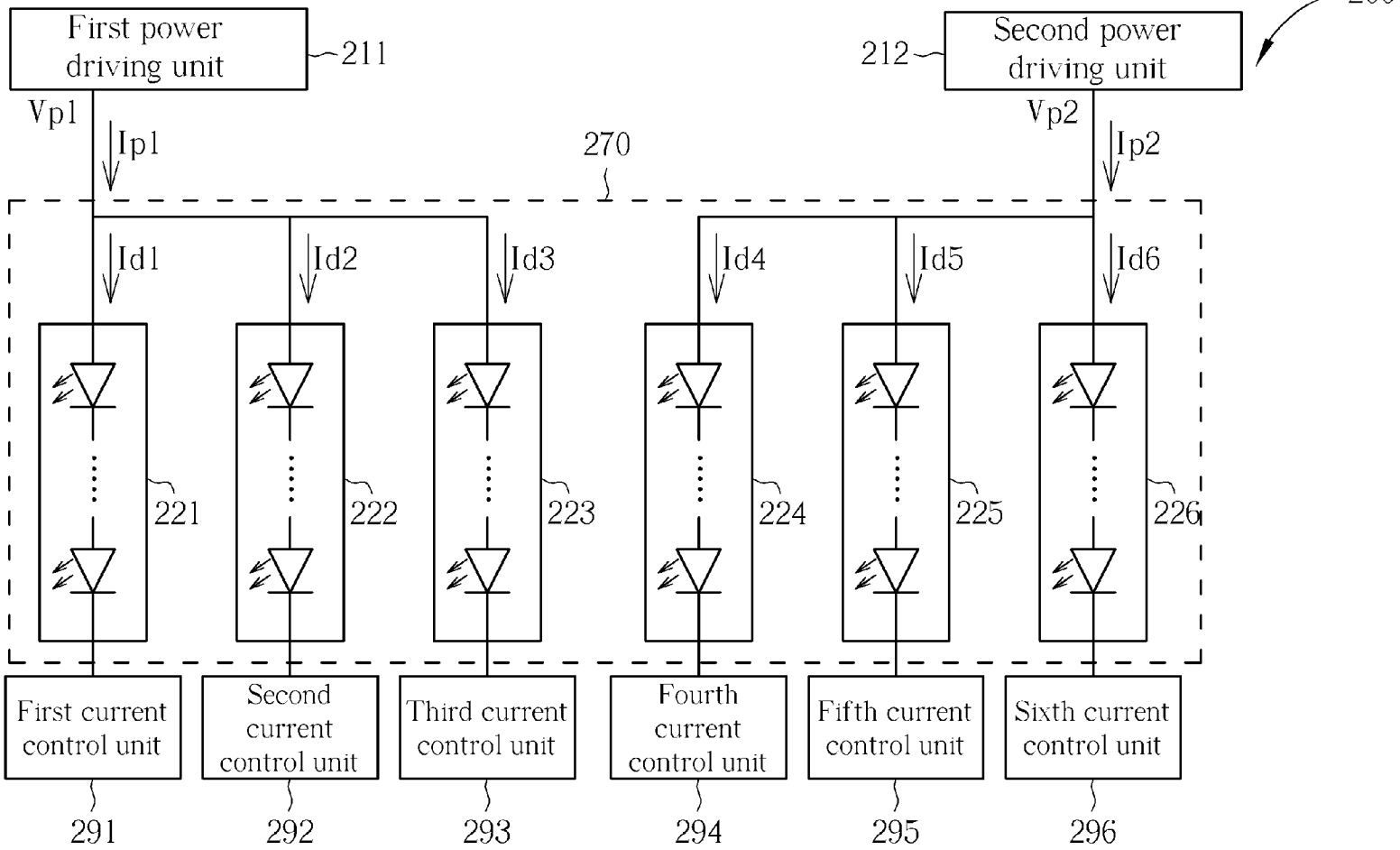
FIG. 4 PRIOR ART
FIG. 4 shows another related art lighting system operating as a backlight module.
Figure 5:
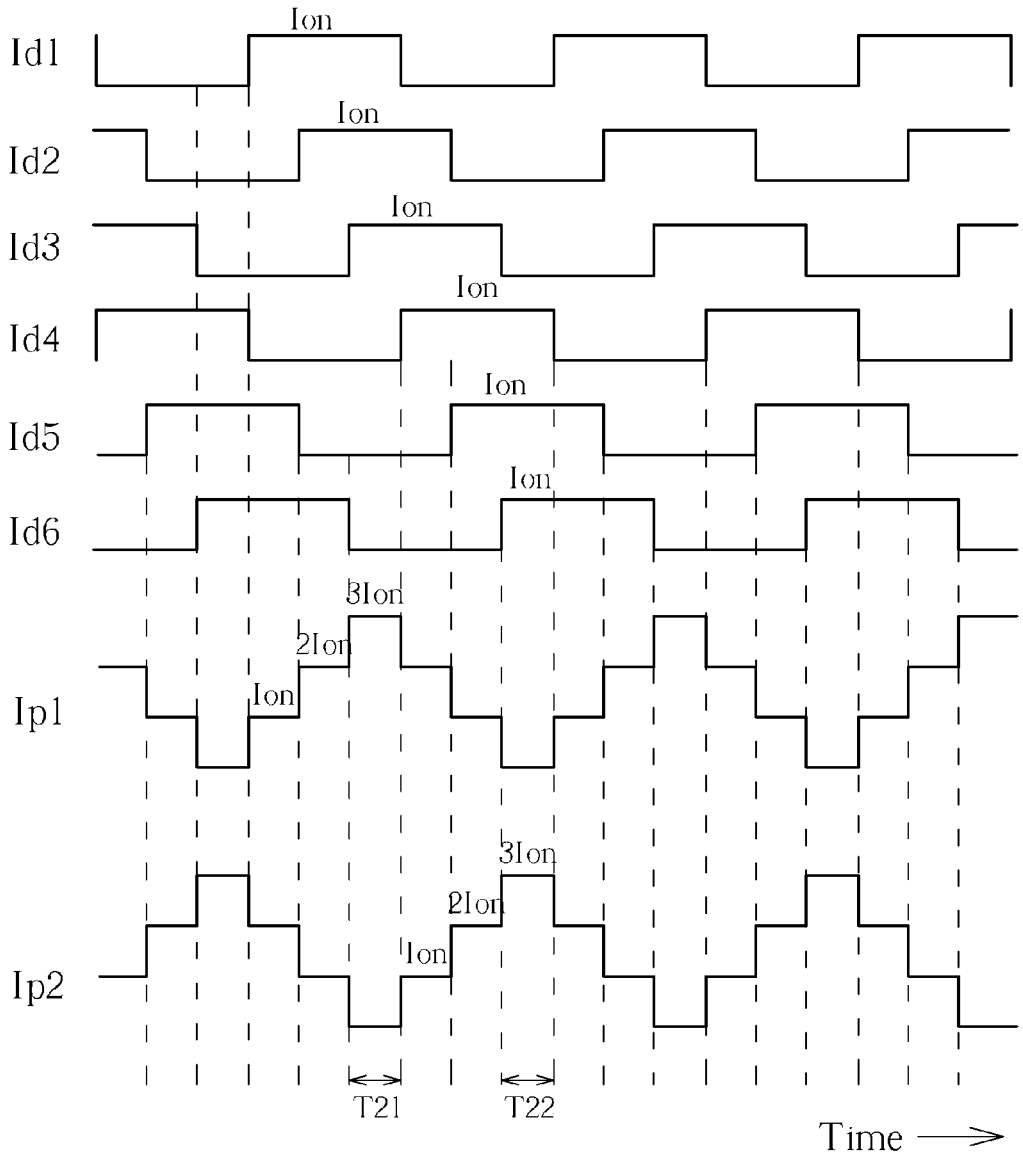
FIG. 5 PRIOR ART
FIG. 5 shows the waveforms of signals for operating the lighting system of FIG. 4.
Figure 6:
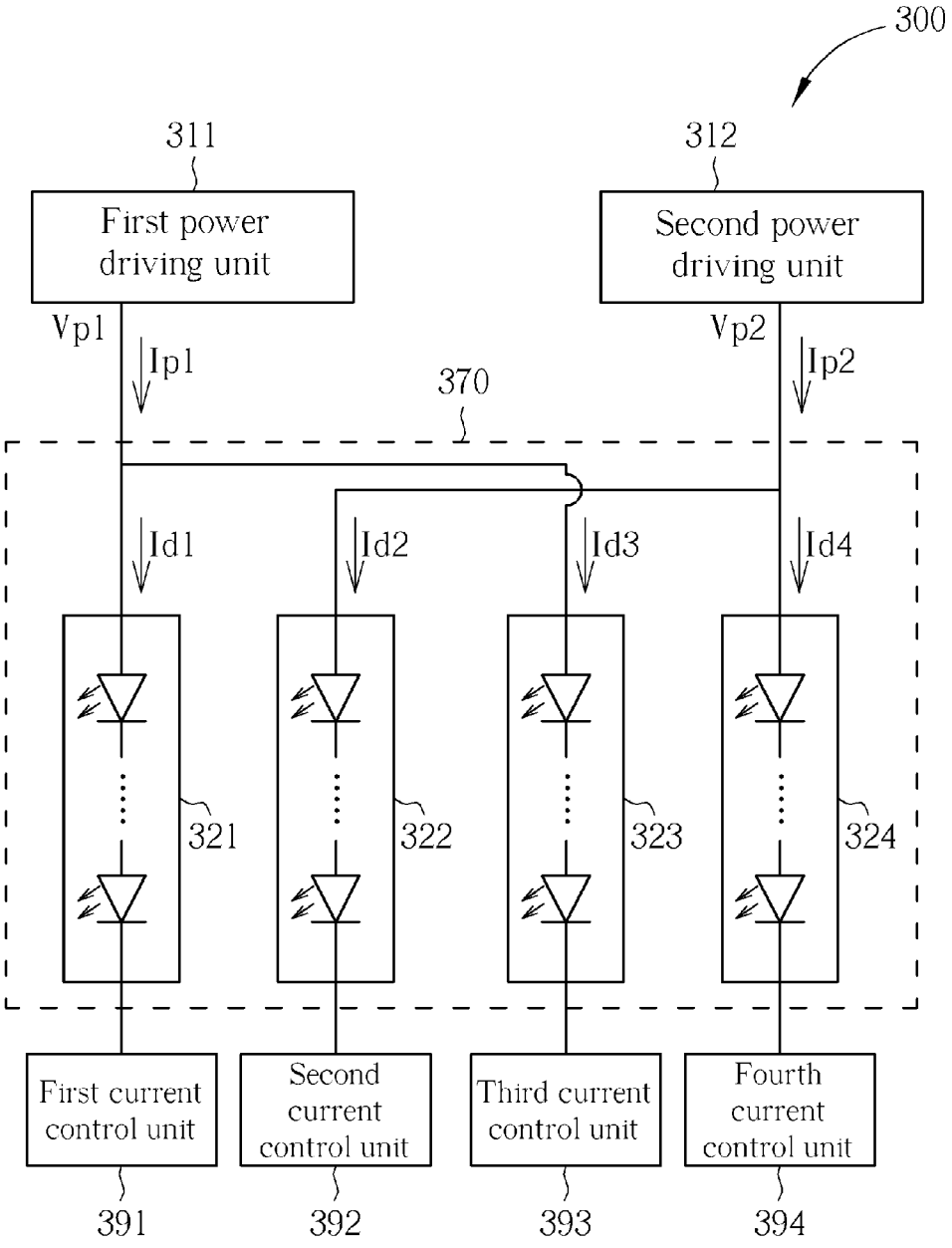
FIG. 6 shows a lighting system having interlaced driving mechanism according to the first embodiment of the present disclosure.

Please refer to FIG. 6, FIG. 6 shows a lighting system 300 having interlaced driving mechanism according to the first embodiment of the present disclosure. As depicted in FIG. 6, the lighting system 300 includes a first power driving unit 311, a second power driving unit 312, a first lighting unit 321, a second lighting unit 322, a third lighting unit 323, a fourth lighting unit 324, a first current control unit 391, a second current control unit 392, a third current control unit 393, a fourth current control unit 394 and a circuit board 370. The first to fourth lighting units 321-324 are disposed on the circuit board 370. The second lighting unit 322 is disposed between the first lighting unit 321 and the third lighting unit 323. The third lighting unit 323 is disposed between the second lighting unit 322 and the fourth lighting unit 324. Thus, the third lighting unit 323 is not adjacent to the first lighting unit 321. The fourth lighting unit 324 is not adjacent to the first lighting unit 321 and the second lighting unit 322.

The first power driving unit 311 is electrically connected to the first lighting unit 321 and the third lighting unit 323 for providing the first sub-current Id1 to the first lighting unit 321 and providing the third sub-current Id3 to the third lighting unit 323. The first current Ip1 is the combined current of the first sub-current Id1 and the third sub-current Id3. The second power driving unit 312 is electrically connected to the second lighting unit 322 and the fourth lighting unit 324 for providing the second sub-current Id2 to the second lighting unit 322 and providing the fourth sub-current Id4 to the fourth lighting unit 324. The second current Ip2 is the combined current of the second sub-current Id2 and the fourth sub-current Id4. That is, the first power driving unit 311 and the second power driving unit 312 use an interlaced driving mechanism to drive the first to fourth lighting units 321-324. The first to fourth current control units 391-394 are electrically connected to the first to fourth lighting units 321-324 to control the first to fourth sub-currents Id1-Id4 respectively so as to adjust light outputs of the first to fourth lighting units 321-324.

Figure 7:
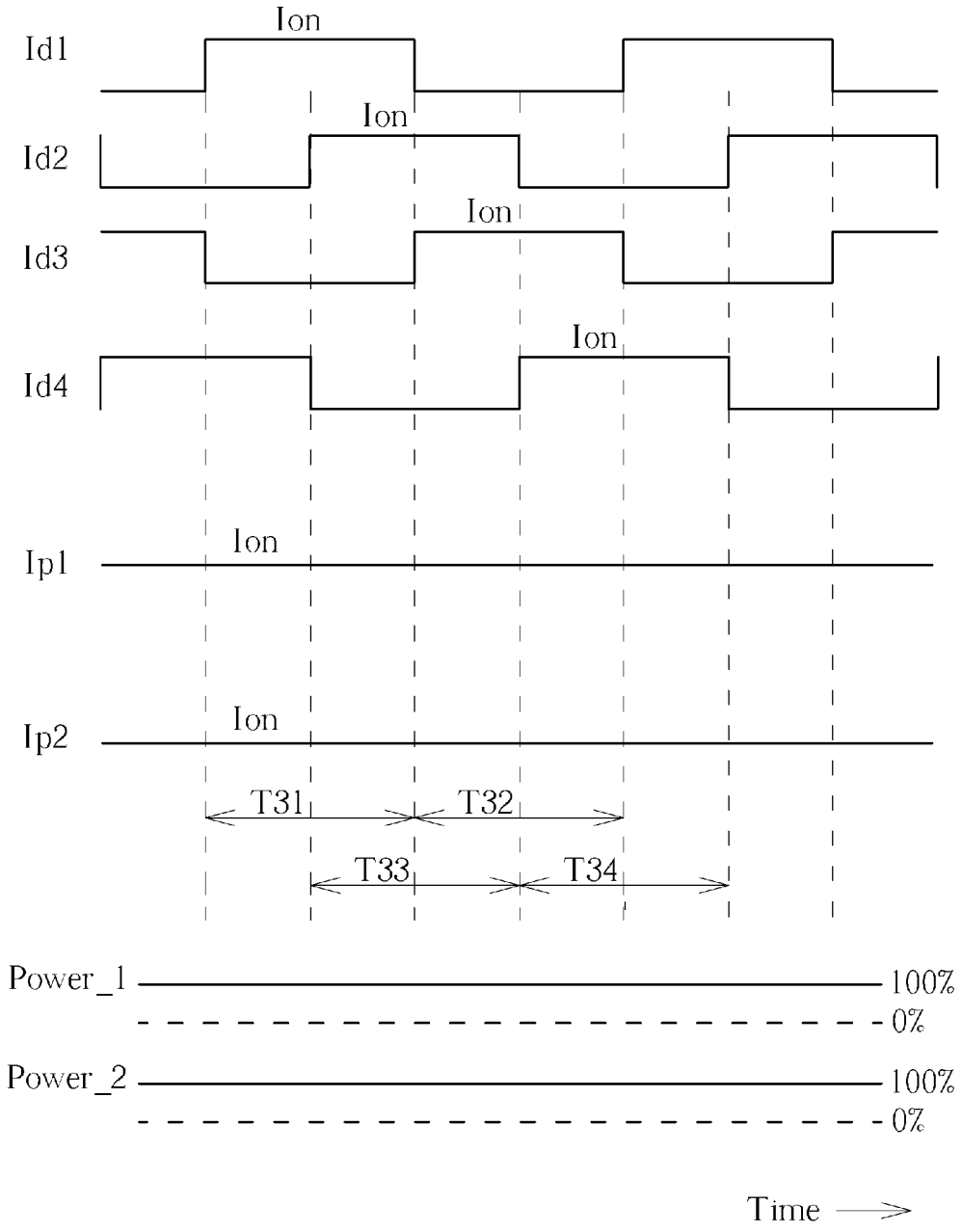
FIG. 7 shows the waveforms of signals for operating the lighting system of FIG. 6.

Please refer to FIG. 7. FIG. 7 shows the waveforms of signals for operating the lighting system 300 of FIG. 6. The horizontal axis represents time. In FIG. 7, waveforms of the first sub-current Id1, the second sub-current Id2, the third sub-current Id3, the fourth sub-current Id4, the first current Ip1 and the second current Ip2 are shown from top to bottom. As depicted in FIG. 7, the phase difference between two successive currents of the first sub-current Id1 to the fourth sub-current Id4 is 90 degrees, e.g. the phase difference between the first sub-current Id1 and the second sub-current Id2 is 90 degrees. Therefore, the waveform of the third sub-current Id3 is substantially inverse to the waveform of the first sub-current Id1, and the waveform of the fourth sub-current Id4 is substantially inverse to the waveform of the second sub-current Id2. During period T31, the level of the first sub-current Id1 is Ion, and the level of the third sub-current Id3 is about 0, thus the level of the first current Ip1 substantially equals to Ion. During period T32, the level of the first sub-current Id1 is about 0, and the level of the third sub-current Id3 is Ion, thus the level of the first current Ip1 substantially equals to Ion. During period T33, the level of the second sub-current Id2 is Ion, and the level of the fourth sub-current Id4 is about 0, thus the level of the second current Ip2 substantially equals to Ion. During period T34, the level of the second sub-current Id2 about 0, and the level of the fourth sub-current Id4 is Ion, thus the level of the second current Ip2 substantially equals to Ion. Therefore, the levels of the first current Ip1 and the second current Ip2 are maintained at Ion when operating the lighting system 300. Thus, when operating the first power driving unit 311 and the second power driving unit 312, the rated power of the first power driving unit 311 only has to exceed Ion×Vp1, and the rated power of the first power driving unit 312 only has to exceed Ion×Vp2, greatly reducing the maximum power output and simplifying the design complexity. Vp1 and Vp2 denote the power voltage outputted from the first power driving unit 311 and the second power driving unit 312 respectively.

In FIG. 7, Power_1 denotes the power output of the first power driving unit 311, and Power_2 denotes the power output of the second power driving unit 312. In this embodiment, Power_1 is 100% of a rated power of the first power driving unit 311, and Power_2 is 100% of a rated power of the second power driving unit 312. Thus, it can be seen that compared with the prior lighting systems 100 and 200, the power outputs of the first power driving unit 311 and the second power driving unit 312 of the lighting system 300 are both stable are will not dramatically vary.

Figure 8:
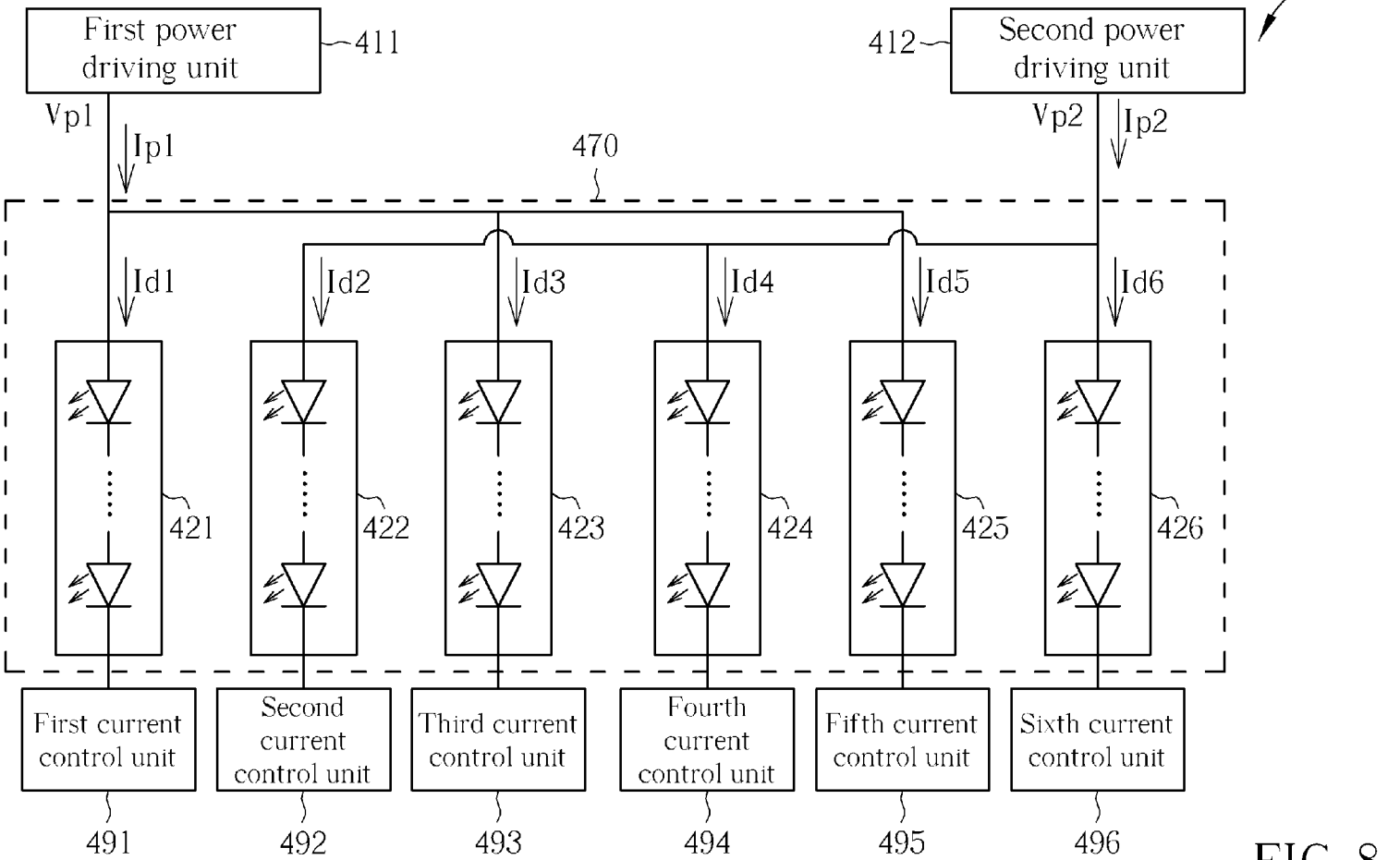
FIG. 8 shows a lighting system having interlaced driving mechanism according to the second embodiment of the present disclosure.

Please refer to FIG. 8. FIG. 8 shows a lighting system 400 having interlaced driving mechanism according to the second embodiment of the present disclosure. As depicted in FIG. 8, the lighting system 400 includes a first power driving unit 411, a second power driving unit 412, a first lighting unit 421, a second lighting unit 422, a third lighting unit 423, a fourth lighting unit 424, a fifth lighting unit 425, a sixth lighting unit 426, a first current control unit 491, a second current control unit 492, a third current control unit 493, a fourth current control unit 494, a fifth current control unit 495, a sixth current control unit 496 and a circuit board 470. The first to sixth lighting units 421-426 are disposed on the circuit board 470. The second lighting unit 422 is disposed between the first lighting unit 421 and the third lighting unit 423. The fourth lighting unit 424 is disposed between the third lighting unit 423 and the fifth lighting unit 425. The sixth lighting unit 426 is disposed next to the fifth lighting unit 425. Thus, the third lighting unit 423 is not adjacent to the first lighting unit 421. The fourth lighting unit 424 is not adjacent to the first lighting unit 421 and the second lighting unit 422. The fifth lighting unit 425 is not adjacent to the first lighting unit 421, the second lighting unit 422 and the third lighting unit 423. The sixth lighting unit 426 is not adjacent to the first lighting unit 421, the second lighting unit 422, the third lighting unit 423 and the fourth lighting unit 424.

The first power driving unit 411 is electrically connected to the first lighting unit 421, the third lighting unit 423 and the fifth lighting unit 425 for providing the first sub-current Id1 to the first lighting unit 421, the third sub-current Id3 to the third lighting unit 423 and the fifth sub-current Id5 to the fifth lighting unit 425. The first current Ip1 is the combined current of the first sub-current Id1, the third sub-current Id3 and the fifth sub-current Id5. The second power driving unit 412 is electrically connected to the second lighting unit 422, the fourth lighting unit 424 and the sixth lighting unit 426 for providing the second sub-current Id2 to the second lighting unit 422, the fourth sub-current Id4 to the fourth lighting unit 424 and the sixth sub-current Id6 to the sixth lighting unit 426. The second current Ip2 is the combined current of the second sub-current Id2, the fourth sub-current Id4 and the sixth sub-current Id6. That is, the first power driving unit 411 and the second power driving unit 412 use an interlaced driving mechanism to drive the first to sixth lighting units 421-426. The first to sixth current control units 491-496 are electrically connected to the first to sixth lighting units 421-426 to control the first to sixth sub-currents Id1-Id6 respectively so as to adjust light outputs of the first to sixth lighting units 421-426.

Figure 9:
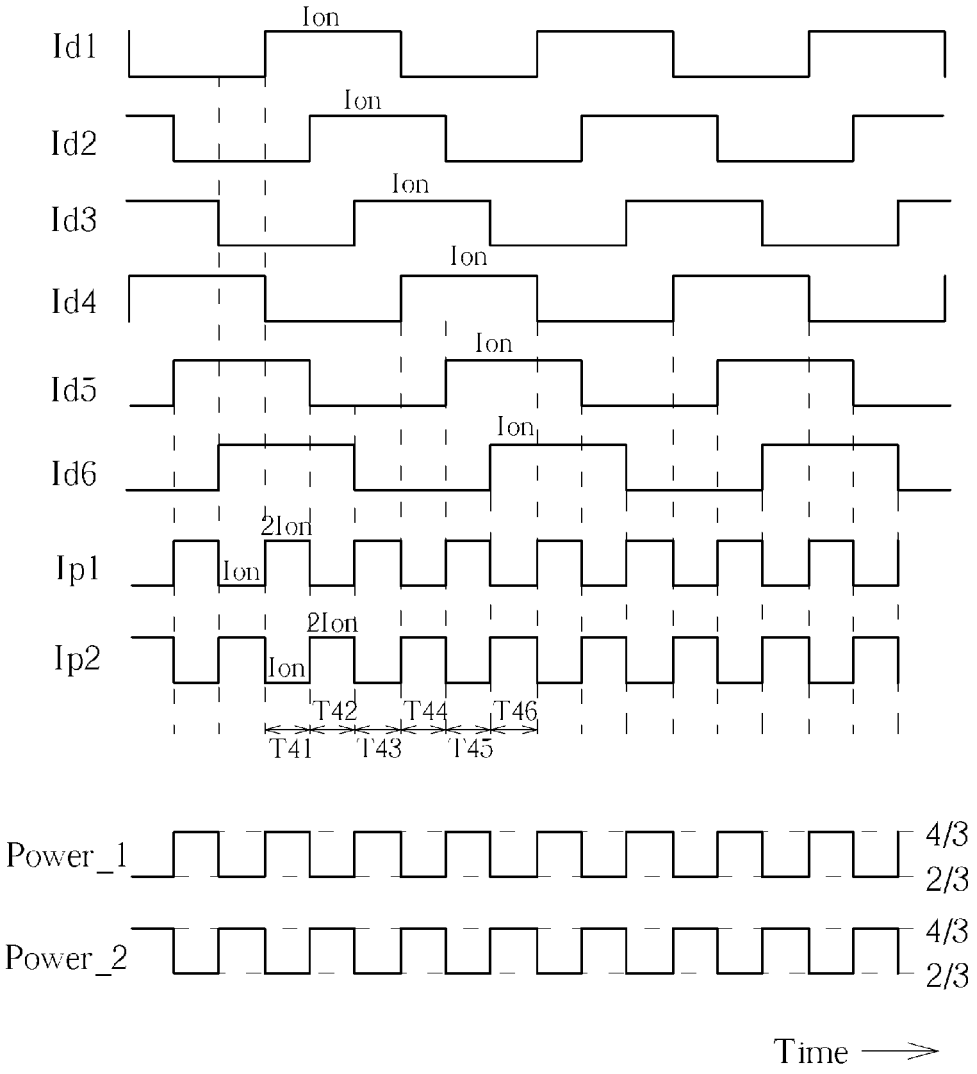
FIG. 9 shows the waveforms of signals for operating the lighting system of FIG. 8.

Please refer to FIG. 9, FIG. 9 shows the waveforms of signals for operating the lighting system of FIG. 8. The horizontal axis represents time. In FIG. 9, waveforms of the first sub-current Id1, the second sub-current Id2, the third sub-current Id3, the fourth sub-current Id4, the fifth sub-current Id5, the sixth sub-current Id6, the first current Ip1 and the second current Ip2 are shown from top to bottom. As depicted in FIG. 9, the phase difference between two successive currents of the first sub-current Id1 to the sixth sub-current Id6 is 60 degrees, e.g. the phase difference between the first sub-current Id1 and the second sub-current Id2 is 60 degrees. During period T31, the level of the first sub-current Id1 is Ion, and the level of the third sub-current Id3 is about 0, thus the level of the first current Ip1 substantially equals to Ion. During period T41, the levels of the first sub-current Id1 and the fifth sub-current Id5 are both Ion, and the level of the third sub-current Id3 is about 0, thus the level of the first current Ip1 substantially equals to 2Ion. Further, the level of the sixth sub-current Id6 is Ion, and the levels of the second sub-current Id2 and fourth sub-current Id4 are both about 0, thus the level of the second power current Ip2 substantially equals to Ion.

During period T42, the level of the first sub-current Id1 is Ion, and the levels of the third sub-current Id3 and the fifth sub-current Id5 are both about 0, thus the level of the first current Ip1 substantially equals to Ion. Further, the levels of the fourth sub-current Id4 and sixth sub-current Id6 are both Ion, and the level of the second sub-current Id2 is about 0, thus the level of the second power current Ip2 substantially equals to 2Ion.

During period T43, the level of the fifth sub-current Id5 is about 0, and the levels of the third sub-current Id3 and the first sub-current Id1 are both Ion, thus the level of the first current Ip1 substantially equals to 2Ion. Further, the levels of the fourth sub-current Id4 and sixth sub-current Id6 are about 0, and the level of the second sub-current Id2 is Ion, thus the level of the second power current Ip2 substantially equals to Ion.

During period T44, the level of the third sub-current Id3 is Ion, and the levels of the fifth sub-current Id5 and the first sub-current Id1 are both about 0, thus the level of the first current Ip1 substantially equals to Ion. Further, the levels of the fourth sub-current Id4 and second sub-current Id2 are both Ion, and the level of the sixth sub-current Id6 is about 0, thus the level of the second power current Ip2 substantially equals to 2Ion.

During period T45, the level of the first sub-current Id1 is about 0, and the levels of the third sub-current Id3 and the fifth sub-current Id5 are both Ion, thus the level of the first current Ip1 substantially equals to 2Ion. Further, the levels of the second sub-current Id2 and sixth sub-current Id6 are both about 0, and the level of the fourth sub-current Id4 is Ion, thus the level of the second power current Ip2 substantially equals to Ion.

During period T46, the level of the fifth sub-current Id5 is Ion, and the levels of the third sub-current Id3 and the first sub-current Id1 are both about 0, thus the level of the first current Ip1 substantially equals to Ion. Further, the levels of the fourth sub-current Id4 and sixth sub-current Id6 are both Ion, and the level of the second sub-current Id2 is about 0, thus the level of the second power current Ip2 substantially equals to 2Ion.

It can be seen from above that when operating the lighting system 400, the maximum value of the first power current Ip1 and the second power current Ip2 are both 2Ion, thus the rated power of the first power driving unit 411 only has to exceed 2Ion×Vp1, and the rated power of the second power driving unit 412 only has to exceed 2Ion×Vp2. Further, the variation range of the outputted power of the first power driving unit 411 is only Ion×Vp1, and the variation range of the outputted power of the second power driving unit 412 is only Ion×Vp2, thus greatly reducing the maximum power outputs and power variation, and simplifying the design complexity. Vp1 and Vp2 denote the power voltage outputted from the first power driving unit 411 and the second power driving unit 412 respectively.

In FIG. 9, Power_1 denotes the power output of the first power driving unit 411, and Power_2 denotes the power output of the second power driving unit 412. In this embodiment, the power output of the first power driving unit 411 is either 2/3 or 4/3 of a rated power of the first power driving unit 411, and the power output of the second power driving unit 412 is either 2/3 or 4/3 of a rated power of the second power driving unit 412. Besides, when the power output of the first power driving unit 411 is 2/3 of the rated power of the first power driving unit 411, the power output of the second power driving unit 412 is 4/3 of the rated power of the second power driving unit 412, and when the power output of the first power driving unit 411 is 4/3 of the rated power of the first power driving unit 411, the power output of the second power driving unit 412 is 2/3 of the rated power of the second power driving unit 412. Thus, it can be seen that compared with the prior lighting systems 100 and 200, the power outputs of the first power driving unit 411 and the second power driving unit 412 of the lighting system 400 are both stable are will not dramatically vary.

Figure 10:
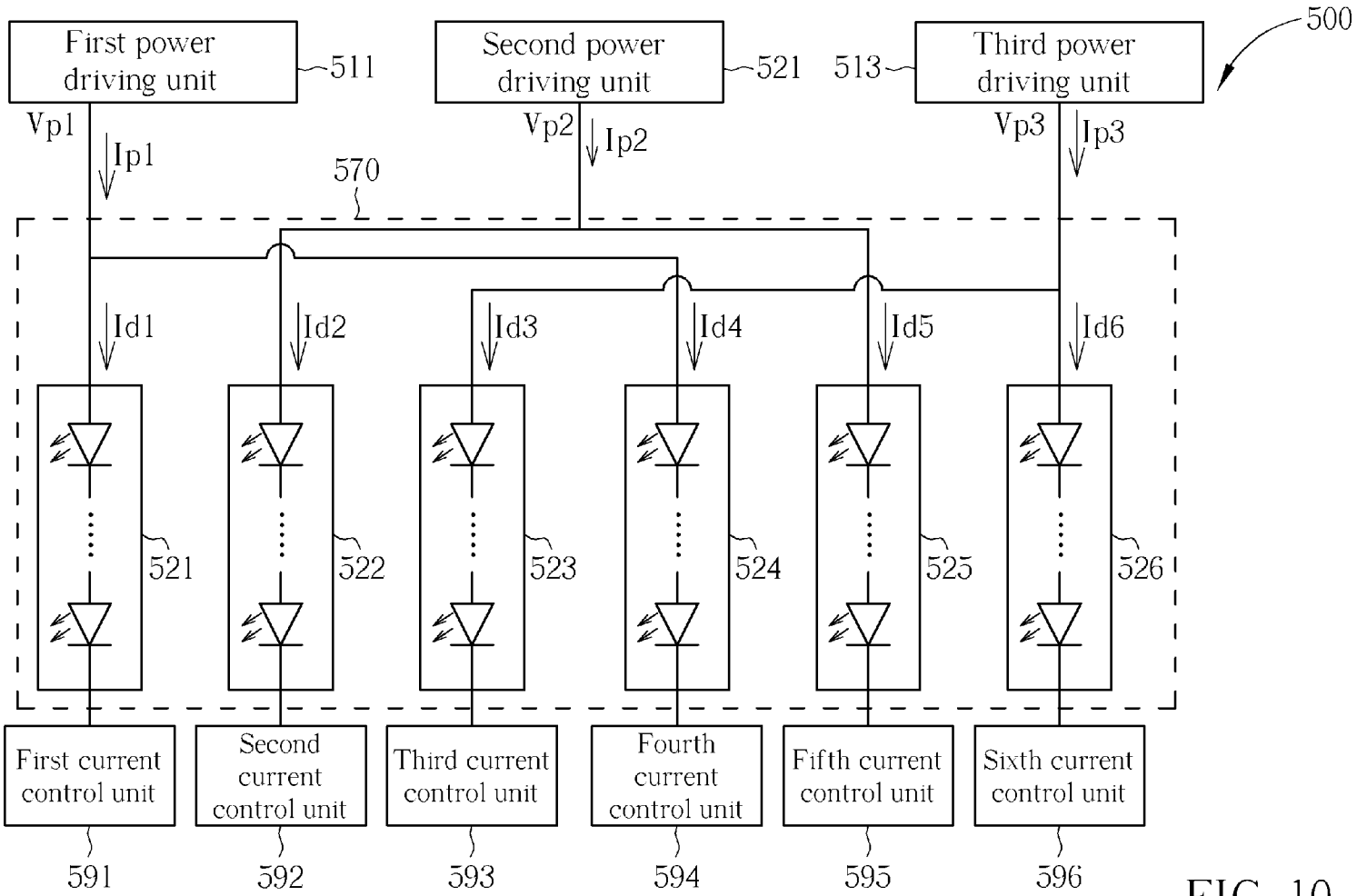
FIG. 10 shows a lighting system having interlaced driving mechanism according to the third embodiment of the present disclosure.

Please refer to FIG. 10, FIG. 10 shows a lighting system 500 having interlaced driving mechanism according to the third embodiment of the present disclosure. As shown in FIG. 10, the lighting system 500 includes a first power driving unit 511, a second power driving unit 512, a third power driving unit 513, a first lighting unit 521, a second lighting unit 522, a third lighting unit 523, a fourth lighting unit 524, a fifth lighting unit 525, a sixth lighting unit 526, a first current control unit 591, a second current control unit 592, a third current control unit 593, a fourth current control unit 594, a fifth current control unit 595, a sixth current control unit 596 and a circuit board 570. The first to sixth lighting units 521-526 are disposed on the circuit board 570. The first power driving unit 511 is electrically connected to the first lighting unit 521 and the fourth lighting unit 524 for providing the first sub-current Id1 to the first lighting unit 521 and the fourth sub-current Id4 to the fourth lighting unit 524. The first current Ip1 is the combined current of the first sub-current Id1 and the fourth sub-current Id4. The second power driving unit 512 is electrically connected to the second lighting unit 522 and the fifth lighting unit 525 for providing the second sub-current Id2 to the second lighting unit 522 and the fifth sub-current Id5 to the fifth lighting unit 525. The second current Ip2 is the combined current of the second sub-current Id2 and the fifth sub-current Id5. The third power driving unit 513 is electrically connected to the third lighting unit 523 and the sixth lighting unit 526 for providing the third sub-current Id3 to the third lighting unit 523 and the sixth sub-current Id6 to the sixth lighting unit 526. The third current Ip3 is the combined current of the third sub-current Id3 and the sixth sub-current Id6. That is, the first power driving unit 511, the second power driving unit 512 and the third power driving unit 513 use an interlaced driving mechanism to drive the first to sixth lighting units 521-526. The first to sixth current control units 591-596 are electrically connected to the first to sixth lighting units 521-526 to control the first to sixth sub-currents Id1-Id6 respectively so as to adjust light outputs of the first to sixth lighting units 521-526.

Figure 11:
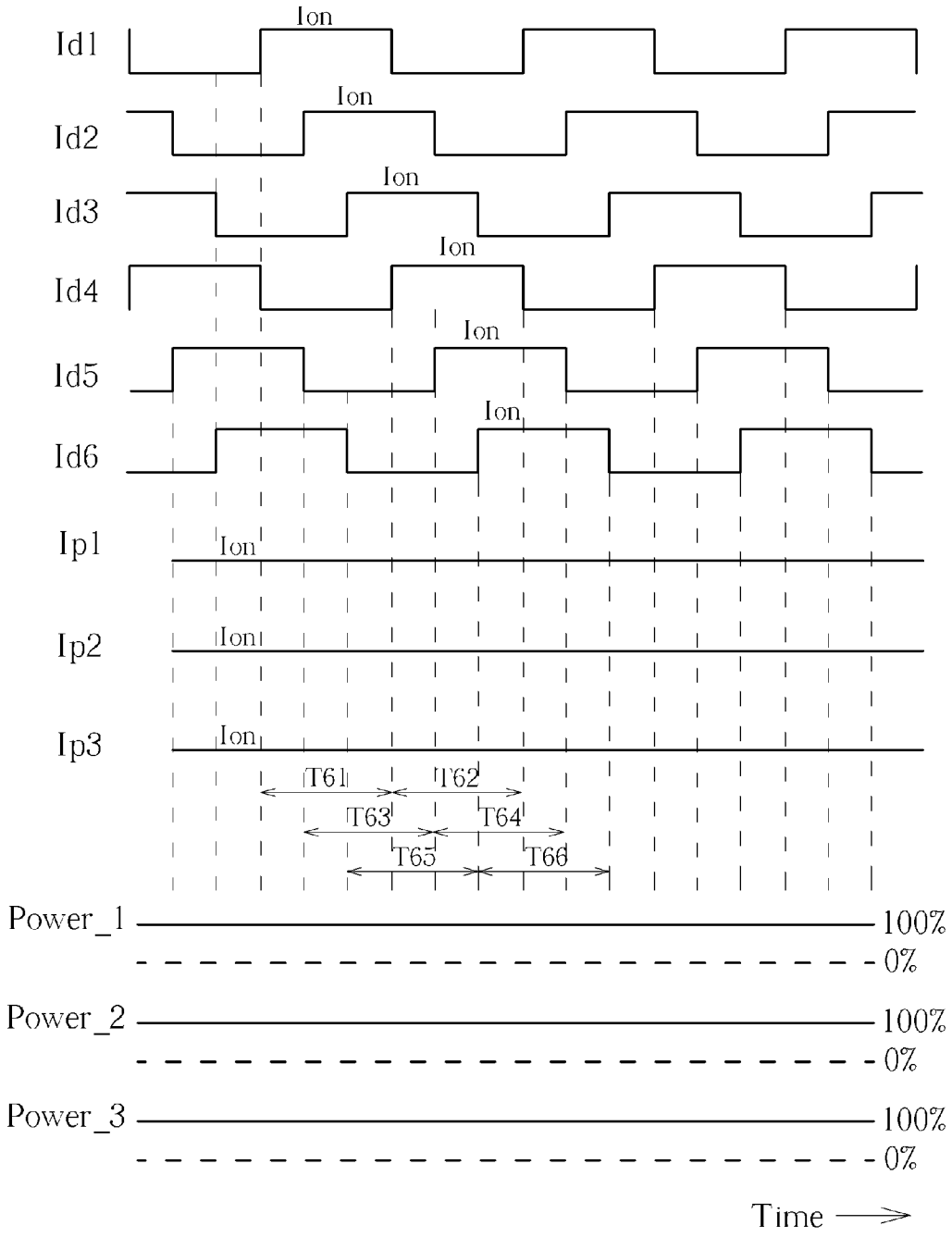
FIG. 11 shows the waveforms of signals for operating the lighting system of FIG. 10.

Please refer to FIG. 11. FIG. 11 shows the waveforms of signals for operating the lighting system of FIG. 10. The horizontal axis represents time. In FIG. 11, waveforms of the first sub-current Id1, the second sub-current Id2, the third sub-current Id3, the fourth sub-current Id4, the fifth sub-current Id5 and the sixth sub-current Id6, the first current Ip1, the second current Ip2 and the third sub-current Ip3 are shown from top to bottom. As depicted in FIG. 11, the phase difference between two successive currents of the first sub-current Id1 to the sixth sub-current Id6 is 60 degrees, e.g. the phase difference between the first sub-current Id1 and the second sub-current Id2 is 60 degrees. Therefore, the waveform of the fourth sub-current Id4 is substantially inverse to the waveform of the first sub-current Id1, the waveform of the fifth sub-current Id5 is substantially inverse to the waveform of the second sub-current Id2, and the waveform of the sixth sub-current Id6 is substantially inverse to the waveform of the third sub-current Id3.

During period T61, the level of the first sub-current Id1 is Ion, and the level of the fourth sub-current Id4 is about 0, thus the level of the first current Ip1 substantially equals to Ion. During period T62, the level of the first sub-current Id1 is about 0, and the level of the fourth sub-current Id4 is Ion, thus the level of the first current Ip1 substantially equals to Ion. During period T63, the level of the second sub-current Id2 is Ion, and the level of the fifth sub-current Id5 is about 0, thus the level of the second current Ip2 substantially equals to Ion. During period T64, the level of the second sub-current Id2 about 0, and the level of the fifth sub-current Id5 is Ion, thus the level of the second current Ip2 substantially equals to Ion. During period T65, the level of the third sub-current Id3 is Ion, and the level of the sixth sub-current Id6 is about 0, thus the level of the second current Ip3 substantially equals to Ion.

During period T66, the level of the third sub-current Id3 about 0, and the level of the sixth sub-current Id6 is Ion, thus the level of the second current Ip3 substantially equals to Ion.

Therefore, it can be seen from above that the levels of the first current Ip1, the second current Ip2 and the third current Ip3 are maintained at Ion when operating the lighting system 500, and the first power driving unit 511, the second power driving unit 512 and the third power driving unit 513 are used to maintain the power level. Thus, when operating the first power driving unit 511, the second power driving unit 512 and the third power driving unit 513, the rated power of the first power driving unit 511 only has to exceed Ion×Vp1, the rated power of the first power driving unit 512 only has to exceed Ion×Vp2, and the rated power of the first power driving unit 513 only has to exceed Ion×Vp3, thus greatly reducing the maximum power outputs and simplifying the design complexity. Vp1, Vp2 and Vp3 denote the power voltage outputted from the first power driving unit 511, the second power driving unit 512 and the third power driving unit 513 respectively.

In FIG. 11, Power_1 denotes the power output of the first power driving unit 511, Power_2 denotes the power output of the second power driving unit 512, and Power_3 denotes the power output of the third power driving unit 513. In this embodiment, Power_1 is 100% of a rated power of the first power driving unit 511, Power_2 is 100% of a rated power of the second power driving unit 512, and Power_3 is 100% of a rated power of the third power driving unit 513. Thus, it can be seen that compared with the prior lighting systems 100 and 200, the power outputs of the first power driving unit 511, the second power driving unit 512 and the third power driving unit 513 of the lighting system 500 are both stable are will not dramatically vary.

In the previous embodiments, the number of lighting units and the number of power driving units are not limited by the above embodiments of the present disclosure. That is, the interlaced mechanism can be configured with more lighting units and/or more power driving units. Besides, the phase difference between driving currents of two successive lighting units only has to be greater than 0, it is not limited to the above embodiments. In short, the lighting systems of the present disclosure reduce the maximum output current of each power driving unit through utilizing interlace mechanisms, thus reducing the maximum output power and power variation of each power driving unit. Further, circuit elements with lower rated power can be applied to the light systems of the present disclosure to reduce the manufacturing cost and simplify the design complexity.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A lighting system having interlaced driving mechanism comprising:

a first lighting unit for generating output light with first brightness according to a first current;

a second lighting unit disposed adjacent to the first lighting unit for generating output light with second brightness according to a second current;

a third lighting unit disposed adjacent to the second lighting unit for generating output light with third brightness according to a third current;

a fourth lighting unit disposed adjacent to the third lighting unit but not adjacent to the first lighting unit and the second lighting unit for generating output light with fourth brightness according to a fourth current;

a first power driving unit electrically connected to the first lighting unit and the third lighting unit for providing the first current to the first lighting unit and the third current to the third lighting unit; and a second power driving unit electrically connected to the second lighting unit and the fourth lighting unit for providing the second current to the second lighting unit and the fourth current to the fourth lighting unit;

wherein the second lighting unit is disposed between the first lighting unit and the third lighting unit, the third lighting unit is disposed between the second lighting unit and the fourth lighting unit, a distance from the first lighting unit to the second lighting unit and a distance from the second lighting unit to the third light unit are shorter than a distance from the second lighting unit to the fourth lighting unit, and the distance from the second lighting unit to the third lighting unit and a distance from the third lighting unit to the fourth lighting unit are shorter than a distance from the first lighting unit to the third lighting unit; and wherein a power output of the first power driving unit is 100% of a rated power of the first power driving unit, and a power output of the second power driving unit is 100% of a rated power of the second power driving unit.

2. The lighting system of claim 1, wherein the third lighting unit is adjacent to the second lighting unit.

3. The lighting system of claim 1, wherein a phase difference between a waveform of the second current and a waveform of the first current is substantially 90 degrees.

4. The lighting system of claim 1, wherein a waveform of the second current and a waveform of the first current are substantially not in phase.

5. The lighting system of claim 1, further comprising:

a first current control unit electrically connected to the first lighting unit for controlling the first current flowing through the first lighting unit;

a second current control unit electrically connected to the second lighting unit for controlling the second current flowing through the second lighting unit;

a third current control unit electrically connected to the third lighting unit for controlling the third current flowing through the third lighting unit; and a fourth current control unit electrically connected to the fourth lighting unit for controlling the fourth current flowing through the fourth lighting unit.

6. The lighting system of claim 1, wherein a waveform of the third current is substantially inverse to a waveform of the first current, and a waveform of the fourth current is substantially inverse to a waveform of the second current.

7. The lighting system of claim 1 further comprising:

a fifth lighting unit disposed adjacent to the fourth lighting unit but not adjacent to the first lighting unit, the second lighting unit and the third lighting unit for generating output light with fifth brightness according to a fifth current; and a sixth lighting unit disposed adjacent to the fifth lighting unit but not adjacent to the first lighting unit, the second lighting unit, the third lighting unit and the fourth lighting unit for generating output light with sixth brightness according to a sixth current;

wherein the first power driving unit is electrically connected to the fifth lighting unit for providing the fifth current to the fifth lighting unit, and the second power driving unit is electrically connected to the sixth lighting unit for providing the sixth current to the sixth lighting unit.

8. The lighting system of claim 7, further comprising:

a first current control unit electrically connected to the first lighting unit for controlling the first current flowing through the first lighting unit;

a second current control unit electrically connected to the second lighting unit for controlling the second current flowing through the second lighting unit;

a third current control unit electrically connected to the third lighting unit for controlling the third current flowing through the third lighting unit;

a fourth current control unit electrically connected to the fourth lighting unit for controlling the fourth current flowing through the fourth lighting unit;

a fifth current control unit electrically connected to the fifth lighting unit for controlling the fifth current flowing through the fifth lighting unit; and a sixth current control unit electrically connected to the sixth lighting unit for controlling the sixth current flowing through the sixth lighting unit.

9. The lighting system of claim 7, wherein a waveform of the fourth current is substantially inverse to a waveform of the first current, a waveform of the fifth current is substantially inverse to a waveform of the second current, and a waveform of the sixth current is substantially inverse to a waveform of the third current.

10. The lighting system of claim 7, wherein a phase difference between a waveform of the second current and a waveform of the first current is substantially 60 degrees.

11. A lighting system having interlaced driving mechanism comprising:

a first lighting unit for generating output light with first brightness according to a first current;

a second lighting unit disposed adjacent to the first lighting unit for generating output light with second brightness according to a second current;

a third lighting unit disposed adjacent to the second lighting unit for generating output light with third brightness according to a third current;

a fourth lighting unit disposed adjacent to the third lighting unit for generating output light with fourth brightness according to a fourth current;

a fifth lighting unit disposed adjacent to the fourth lighting unit for generating output light with fifth brightness according to a fifth current;

a sixth lighting unit disposed adjacent to the fifth lighting unit for generating output light with sixth brightness according to a sixth current;

a first power driving unit electrically connected to the first lighting unit and the fourth lighting unit for providing the first current to the first lighting unit and the fourth current to the fourth lighting unit;

a second power driving unit electrically connected to the second lighting unit and the fifth lighting unit for providing the second current to the second lighting unit and the fifth current to the fifth lighting unit; and a third power driving unit electrically connected to the third lighting unit and the sixth lighting unit for providing the third current to the third lighting unit and the sixth current to the sixth lighting unit;

wherein the second lighting unit is disposed between the first lighting unit and the third lighting unit, the third lighting unit is disposed between the second lighting unit and the fourth lighting unit, the fourth lighting unit is disposed between the third lighting unit and the fifth lighting unit, the fifth lighting unit is disposed between the fourth lighting unit and the sixth lighting unit, a distance from the second lighting unit to the first lighting unit and a distance from the second lighting unit to the third light unit are shorter than a distance from the second lighting unit to the fourth lighting unit, a distance from the second lighting unit to the fifth lighting unit, and a distance from the second lighting unit to the sixth lighting unit, the distance from the second lighting unit to the third lighting unit and a distance from the third lighting unit to the fourth lighting unit are shorter than a distance from the first lighting unit to the third lighting unit, a distance from the third lighting unit to the fifth lighting unit, and a distance from the third lighting unit to the sixth lighting unit, the distance from the third lighting unit to the fourth lighting unit and a distance from the fourth lighting unit to the fifth lighting unit are shorter than a distance from the first lighting unit to the fourth lighting unit, the distance from the second lighting unit to the fourth lighting unit, and a distance from the fourth lighting unit to the sixth lighting unit, the distance from the fourth lighting unit to the fifth lighting unit and a distance from the fifth lighting unit to the sixth lighting unit are shorter than a distance from the first lighting unit to the fifth lighting unit, the distance from the second lighting unit to the fifth lighting unit, and the distance from the third lighting unit to the fifth lighting unit; and wherein a power output of the first power driving unit is 100% of a rated power of the first power driving unit, a power output of the second power driving unit is 100% of a rated power of the second power driving unit, and a power output of the third power driving unit is 100% of a rated power of the third power driving unit.

12. The lighting system of claim 11, further comprising:

a first current control unit electrically connected to the first lighting unit for controlling the first current flowing through the first lighting unit;

a second current control unit electrically connected to the second lighting unit for controlling the second current flowing through the second lighting unit;

a third current control unit electrically connected to the third lighting unit for controlling the third current flowing through the third lighting unit;

a fourth current control unit electrically connected to the fourth lighting unit for controlling the fourth current flowing through the fourth lighting unit;

a fifth current control unit electrically connected to the fifth lighting unit for controlling the fifth current flowing through the fifth lighting unit; and a sixth current control unit electrically connected to the sixth lighting unit for controlling the sixth current flowing through the sixth lighting unit.

13. The lighting system of claim 11, wherein a waveform of the fourth current is substantially inverse to a waveform of the first current, a waveform of the fifth current is substantially inverse to a waveform of the second current, and a waveform of the sixth current is substantially inverse to a waveform of the third current.

14. The lighting system of claim 11, wherein a phase difference between a waveform of the second current and a waveform of the first current is substantially 60 degrees.

* * * * *